United States Patent [19]

Gundlach et al.

[11] Patent Number: 4,556,013

[45] Date of Patent: Dec. 3, 1985

[54] SCREENED DONOR FOR TOUCHDOWN DEVELOPMENT

[75] Inventors: Robert W. Gundlach, Victor; William M. Schwarz, Jr., Webster; Kenneth W. Gunther, Rochester, all of N.Y.

[73] Assignee: Xerox Corporation, Stamford, Conn.

[21] Appl. No.: 549,096

[22] Filed: Nov. 7, 1983

[51] Int. Cl.[4] ..... G03G 15/08

[52] U.S. Cl. ..... 118/624; 118/650; 118/653

[58] Field of Search ..... 430/120; 118/624, 640, 118/650, 653

[56] References Cited

U.S. PATENT DOCUMENTS

| | | | |
|---|---|---|---|
| 2,576,047 | 11/1951 | Schaffert | 101/426 |
| 3,038,442 | 6/1962 | Jones et al. | 118/653 |
| 3,203,394 | 8/1965 | Hope et al. | 118/637 |
| 3,470,009 | 9/1969 | Gundlach | 117/17.5 |
| 3,739,748 | 6/1973 | Rittler et al. | 118/637 |
| 3,790,397 | 2/1974 | Weiler | 118/650 |
| 3,799,113 | 3/1974 | Whited | 118/637 |
| 3,998,185 | 12/1976 | Weiler | 118/651 |
| 4,011,834 | 3/1977 | Stephan | 118/653 |
| 4,144,061 | 3/1979 | Bean | 96/1 SD |

*Primary Examiner*—John L. Goodrow

*Attorney, Agent, or Firm*—Henry William A.

[57] ABSTRACT

A touchdown development system includes a donor roll for positioning adjacent a photosensitive member in order to develop an image on the surface of the photosensitive member. A "C-shell" toner housing is positioned around the donor roll to extend from the 6 o'clock to 9 o'clock position and filled with single component toner and about 1% aerosil. A stationary and open mesh screen is placed adjacent the donor roll so that a dense, uniform layer of well charged toner is formed on the donor roll for transfer to the photosensitive member surface. The screen leaves contact with the donor roll at a distance above the top of toner bath to thereby remove any excess toner from the donor roll surface.

10 Claims, 2 Drawing Figures

SCREENED DONOR FOR TOUCHDOWN DEVELOPMENT

This method and apparatus relates to electrostatic image development and more particularly to an improved xerographic method and apparatus for the development of electrostatic images by which a toner layer is presented to the latent image for development thereof.

In the reproduction process xerography, a photoconductive surface is charged and then exposed to a light pattern of the information to be reproduced, thereby forming an electrostatic latent image on the photoconductive surface. Charged toner particles, which may be finely divided, pigmented, resinous material are presented to the latent image where they are attracted to the photoconductive surface. The toner image can be fixed and made permanent on the photoconductive surface or it can be transferred to another surface where it is fixed.

One known method of developing electrostatic latent images is by a process called transfer development. Transfer development broadly involves bringing a layer of toner to an imaged photoconductor where toner particles will be transferred from the layer to the imaged areas. In one transfer development technique, a layer of charged toner particles is applied to a donor member which is capable of retaining the particles on its surface and then the donor member is brought into close proximity to the surface of the photoconductor. In the closely spaced position, particles of toner in the toner layer on the donor member, are attracted to the photoconductor by the electrostatic charge on the photoconductor opposite to the toner charge so that development takes place. In this technique the toner particles must traverse an air gap to reach the imaged regions of the photoconductor. In the two other transfer techniques the toner-laden donor actually contacts the imaged photoreceptor and no air gap is involved. In one such technique, the toner-laden donor is rolled in non-slip relationship into and out of contact with the electrostatic latent image to develop the image in a single rapid step. In another such technique, the toner-laden donor is skidded across the xerographic surface. Skidding the toner by as much as the width of a thin line will double the amount of toner available for development of the line if it lies perpendicular to the skid direction. The amount of skidding can be increased to achieve greater density or greater area coverage.

It is to be noted, therefore, that the term "transfer development" is generic to development techniques where (1) the toner layer is out of contact with the imaged photoconductor and the toner particles must traverse an air gap to effect development, (2) the toner layer is brought into rolling contact with the imaged photoconductor to effect development, and (3) the toner layer is brought into skidding contact with the imaged photoreceptor to effect development. Transfer development has also come to be known as "touchdown development."

In a typical transfer development system, a cylindrical or endless donor member is rotated so that its surface can be presented to the moving surface of a photoconductive drum bearing an electrostatic latent image thereon. Positioned about the periphery of the donor member are a number of processing stations including, a donor loading station, at which toner is presented to and coated on the donor member surface; an agglomerate removal station at which toner agglomerates and excess toner are removed from the toner layer retained on the surface of the donor member; a charging station at which a uniform charge is placed on the particles of toner retained on the donor surface; a clean up station at which the toner layer is converted into one of uniform thickness and uniform charge state at which any toner agglomerates not removed by the agglomerate removal station are removed; a development station at which toner particles carried by said donor member are presented to the imaged photoconductor for image development; and a cleaning station at which a neutralizing charge is placed upon the residual toner particles and at which a cleaning member removes residual toner from the peripheral surface of the photoreceptor. In this manner, a continuous development process is carried out.

Among the donor members employed in the prior art are those embodying the principles described in U.S. Pat. No. 3,203,394. Such a donor includes, an electrically conductive support member in the form of a cylinder, a thin electrically insulating layer overlying a support member, and a continuous, electrically conductive screen pattern is provided with an electrical connection to a slip ring so that its potential may be varied between ground potential and a charge potential at different stages of process. A multitude of high fringe fields or microfields are created at the surface of this type of donor member. When this type of donor member is brought into contact with toner particles, it is in this manner loaded with toner.

A donor member of this type is quite expensive to manufacture, it is quite fragile in the screen regions and is subject to being electrically disabled, e.g., through shorting of the screen to the conductive substrate, unless considerable care is taken during its manufacture and use.

The art of xerographic development, and in particular transfer development, would be significantly advanced if a simpler and more reliable donor member as well as a less costly system were available.

Accordingly, the present invention is directed to a new concept for loading a donor member in a simple and uncomplicated process which includes inserting an open meshed screen in a toner loading hopper directly contacting a donor member in the toner loading zone. The screen serves to friction charge the toner after it passes through the open mesh and rubs against the donor member thereby forming a dense and uniform layer of toner on the surface of the donor member.

The advantages of this system include the lack of airborne dust, simplicity, elimination of toner concentration problems, excellent solid area development, single component development that transfers well even at high humidity, and the capability of using colored non-magnetic toners.

For a better understanding of the invention as well as further features thereof, reference is made to the accompanying drawing, wherein.

The present invention is a transfer development system and method in which toner particles are applied to an electrostatic latent image on a photoconductive plate to develop the image. Although the system and method is described herein as part of a xerographic copier, it can be utilized in conjunction with any reproduction system wherein a latent image is to be developed by applying toner thereto, e.g., a latent image in an electrographic system or a zero printing system as shown in U.S. Pat. No. 2,576,047.

Figure 1:
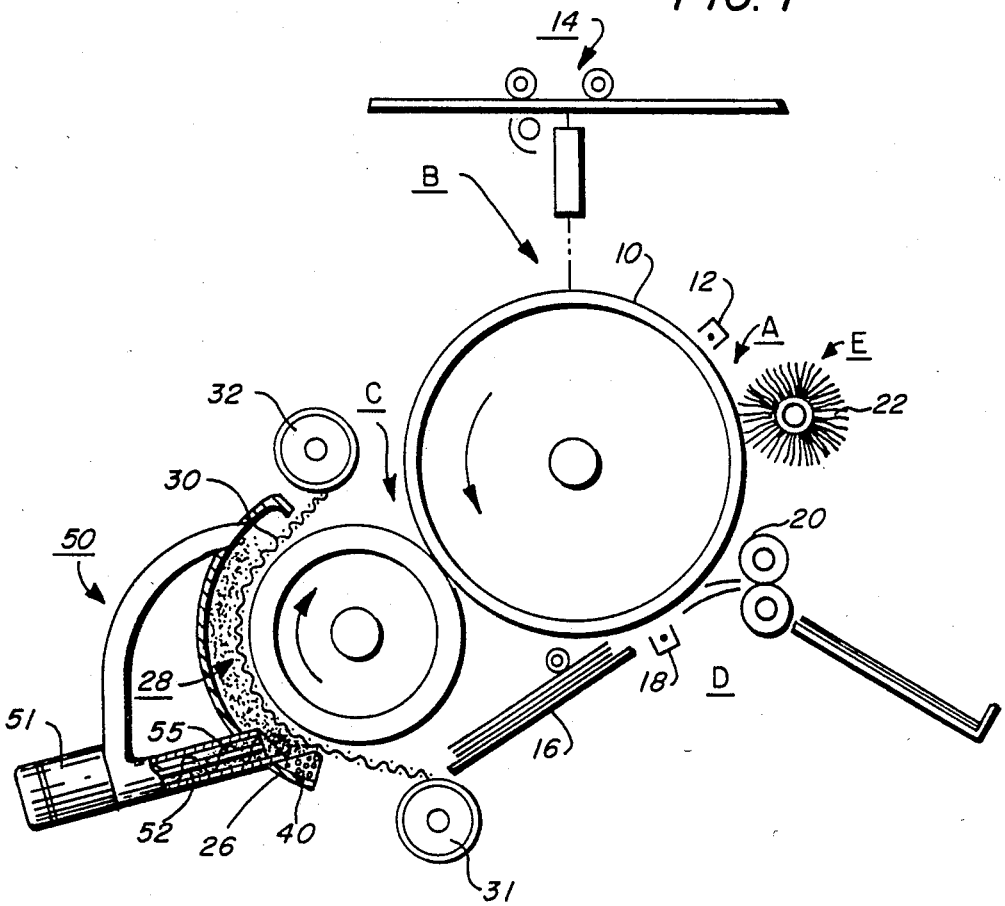
FIG. 1 is a sectional view of an exemplary xerographic apparatus employing the present invention.

Referring to FIG. 1, there is shown a xerographic reproduction system utilizing the concept of the present invention. In this apparatus a xerographic plate is in the form of a drum 10 which passes through stations A–E in the direction shown by the arrow. The drum has a suitable photosensitive surface, such as one including selenium overlying a layer of conductive material, on which a latent electrostatic image can be formed. The various stations about the periphery of the drum which carry out the reproduction process are: charging station A, exposing station B, developing station C, transfer station D, and cleaning station E. Stations A, B, D, and E represent a conventional means for carrying out their respective functions. Apart from their association with the novel arrangement to be described with respect to station C they form no part of the present invention.

At station A, a suitable charging means 12, e.g., a corotron, places a uniform electrostatic charge on the photoconductive material. As the drum rotates, a light pattern, via a suitable exposing apparatus 14, e.g., a projector, is exposed onto the charged surface of drum 10. The latent image thereby formed on the surface of the drum is developed or made visible by the application of a finely divided pigmented, resinous powder called toner at developing station C, which is described in greater detail below. After the drum is developed at station C, it passes through transfer station D, comprising copy sheet 16, corona charging device 18 and fuser device 20. Following transfer and fixing of the developed image to the copy sheet, the drum rotates through cleaing station E, comprising cleaning device 22, e.g., a rotating brush.

At developing station C, the apparatus includes a donor member 24 rotatably mounted adjacent a toner housing or reservoir 26 containing a supply of toner 28. The donor member or roll 24 is positioned so that a portion of its periphery comes into contact with toner 28. The donor roll is also located so as to contact the surface of drum 10 to present the outer surface of a toner layer carried by donor roll 24 to the drum.

Figure 2:
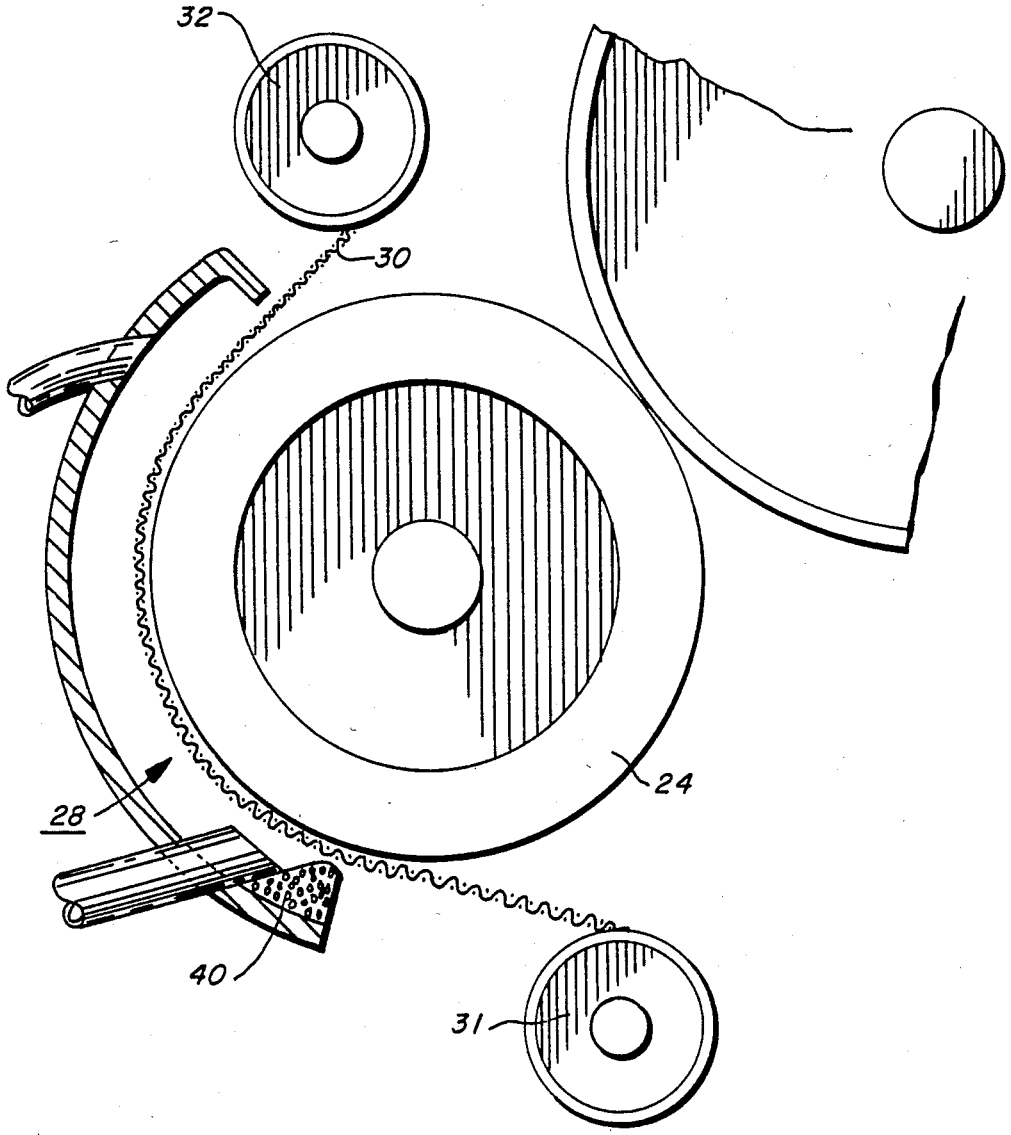
FIG. 2 is an enlarged sectional view of the donor development apparatus shown in FIG. 1.

Referring now to FIG. 2 of the drawing, there is shown a development system of the type contemplated by the present invention. Donor member 24, which in this case is a cyclindrical anodized aluminum drum is positioned so that a portion of its periphery may be rotated into contact with a mass of toner particles 28 in a toner housing or reservoir 26. Located between the toner housing 26 and the donor member 24 is a webbed screen means 30 which is shown rotatably mounted on a supply roll 31 and a take-up roll 32. The screen extends from a position outside the housing 26 into and out of the housing with a portion of its surface in contact with the donor member 24. Preferably, the screen serves three separate functions and in the embodiment illustrated consist of three different segments. First, the lower portion is a coarser mesh to allow toner to flow into contact with the donor more readily. The next section is less coarse and provides the major portion of rubbing action to the toner particles as they pass through the screen toward the donor member surface for tribo charging the toner and the donor member and could have a pad of foam elastomer behind it or other means to provide extra pressure. Then the uppermost segment, being the least coarse, will remove and return excess toner to the sump 28 and gently and uniformly smooth out the charged toner coating to a streak-free uniform layer. Housing 26 is enclosed at one end against screen 30 by seal 40. In order to help toner flow through the screen, a suitable means such as a paddle or auger assembly 50 applies pressure to toner in sump 28 to insure passage of the toner through screen 30 in amounts sufficient to coat donor member 24. A motor 51 through shaft 52 turns auger member 55 to propel toner through the screen. Further, it should be understood that the triple segmented screen could be replaced by a screen with a uniform mesh, if desired that would be unwound from supply roll 31 periodically to present a new friction surface to the toner and donor member. When a new friction surface is desired with the triple segmented screen in use, the supply roll and take-up roll are energized long enough to present a totally new three sectioned screen portion to the toner and donor member.

By just filling toner housing 26 with one component toner (and about 1% aerosil) to about the 9 o'clock level, very little toner will adhere to the donor member since its charge will be much too low. However, by inserting an open mesh screen, e.g., woven or knit Nylon, Dacron Polyester, or porus foam or the like against the donor surface and keeping it stationary against the rotating donor cylinder, a surprisingly dense and uniform layer of well charged toner is formed on the donor member. It is important that the toner and donor materials be selected for tribo charging. It is also important that the screen leaves contact with the donor member at a tangent point well above the top of the toner bath so that any excess toner will be removed from the screen due to gravity and settle back into housing 26. As shown in FIG. 2, the screen has a tangent point in relation to the surface of donor member 24 above 270° and below 360° to accomplish this non-overloading requirement in this embodiment.

In operation, as donor member 24 rotates in the direction shown by the arrow in FIG. 1, at approximately the 180° position the donor member begins taking on toner from a "C-shell" configured developer housing 26 through screen 30 that is now stationarily positioned in friction contact with the outer surface of the donor member from about the 180° position to about the 280° position. Toner passing through the screen is friction charged and adhers to the donor surface. Continued rotation of the donor member brings the toner now loaded onto its outer surface into contact with an oppositely charged latent image on photosensitive member 10 whereby toner is transferred from the donor member to latent image on the photosensitive member for subsequent transfer to copy paper 16 by the use of transfer corotron 18.

In summary, a "touchdown development" system is disclosed that includes a "C-shell" process in which a coarse mesh screen is placed adjacent a donor member in order to meter toner deposition on a donor member and a photoreceptor. The screen serves to friction charge the toner and smooth out the toner layer on the donor surface.

It is to be understood while for purposes of illustration the donor member has been described basically as a cylinder, it may be an endless belt adapted to deliver toner from the toner source to the several stations.

Conventional drive means, e.g., motors, belts, etc. are employed to drive the several movable members all in a manner within the skill of the art.

Since may changes can be made in the above construction and many apparently widely different embodiments of this invention can be made without departing from the scope thereof it is intended that all matter contained in the drawing and specification should be interpreted illustratively and not in a limited sense.

We claim:

1. An electrostatic development apparatus for developing latent electrostatic images on an electrostatic latent image surface adapted to move in a predetermined direction comprising:

a donor member closely spaced from said electrostatic latent image surface and adapted to apply toner to said latent electrostatic images on said electrostatic latent image surface;

housing means adapted to be filled with toner and positioned adjacent said donor member for loading toner onto said donor member for electrostatic transfer to said electrostatic latent image surface; and a webbed screen located in said housing means and adapted to contact said donor member so that the toner loaded from said housing means onto said donor member passes through said webbed screen means in order to make rubbing contact with and form a dense and uniform layer of toner onto the surface of said donor member, said webbed screen serving to friction charge the toner and smooth the layer of toner on said donor member in order to prevent streaking on said photosensitive surface.

2. The electrostatic development apparatus of claim 1, wherein said webbed screen is an open woven or knitted mesh that is adapted to be stationary during development operations.

3. The electrostatic development apparatus of claim 2, wherein said webbed screen is mounted on a web supply roll and attached to a web take-up roll so that periodically a new contacting surface can be presented to the toner in said housing means and said donor member.

4. The electrostatic development apparatus of claim 3, wherein said donor member is cylindrical and said webbed screen contacts the surface of said donor member in an arc from about 180° to about 270° in a clockwise direction.

5. The electrostatic development apparatus of claim 4, wherein said webbed screen leaves contact with the surface of said donor member above the level of toner in said housing means in order to remove excess toner from the donor member area.

6. The electrostatic development apparatus of claim 5, wherein said housing means is filled with single component toner.

7. A method of loading a donor member for touchdown development of latent images on a photosensitive member, comprising the steps of:

providing a reservoir for holding toner;

at least partially filling said reservoir with toner;

positioning a donor member such that a portion of its surface extends into said reservoir; and providing a webbed screen in contacting relationship with an area of the surface of said donor member that extends into said reservoir so that toner passing through said webbed screen is friction charged and a smooth toner layer is applied to said donor member.

8. The method of claim 7, wherein said filling step includes adding one component toner to said reservoir.

9. The method of claim 7, including the step of at predetermined times adjusting said screen to present an unused surface to said donor member.

10. The method of claim 7, including the step of pressure loading the toner against said webbed screen.

* * * * *